US007819167B2

(12) United States Patent
Morin

(10) Patent No.: US 7,819,167 B2
(45) Date of Patent: Oct. 26, 2010

(54) WINDOW ASSEMBLY WITH INTEGRATED PLEATED SCREEN

(76) Inventor: Gilles Morin, 3578 Avenue Vendôme, Montréal, Québec (CA) H4A 3M7

( * ) Notice: Subject to any disclaimer, the term of this patent is extended or adjusted under 35 U.S.C. 154(b) by 1 day.

(21) Appl. No.: 11/183,026

(22) Filed: Jul. 14, 2005

(65) Prior Publication Data

US 2006/0108074 A1 May 25, 2006

Related U.S. Application Data

(60) Provisional application No. 60/587,501, filed on Jul. 14, 2004.

(51) Int. Cl.
*E06B 9/06* (2006.01)

(52) U.S. Cl. ..... 160/102; 160/84.06

(58) Field of Classification Search ..... 160/102, 160/103, 90, 84.04, 84.06, 99, 100, 27, 28
See application file for complete search history.

(56) References Cited

U.S. PATENT DOCUMENTS 912,849 A * 2/1909 Hultgreen ..... 160/102
963,393 A * 7/1910 Riback ..... 160/102
1,007,499 A * 10/1911 Sprinchorn ..... 160/102
1,142,403 A * 6/1915 Davis ..... 49/54
1,220,888 A * 3/1917 Porter ..... 160/84.04
2,276,177 A * 3/1942 Flugger ..... 160/102
2,422,840 A * 6/1947 Mayer ..... 160/34
2,470,433 A * 5/1949 Davis ..... 160/102
5,915,443 A 6/1999 Lindley, Jr.
6,167,936 B1 1/2001 Stover et al.
6,470,947 B1 10/2002 Holevas

FOREIGN PATENT DOCUMENTS

EP 1 118 745 A2 7/2001

* cited by examiner

*Primary Examiner*—David Purol
(74) *Attorney, Agent, or Firm*—Fish & Richardson P.C.

(57) ABSTRACT

A window assembly, the window assembly comprising a window frame, a pair of spaced-apart guide tracks, at least one window sash mounted to and positioned between the a pair of spaced-apart guide tracks, and a foldable and spreadable pleated screen. The window sash is slidably movable along the guide tracks between an open position and a closed position. The pleated screen has a first screen end mounted to the end of the at least one window sash and a second screen end mounted to a first end of the window frame so that the pleated screen extends when the at least one window sash is in the open position and the pleated screen folds onto itself when the at least one window sash is in the closed position. The pleated screen can also be used in double-hung windows.

12 Claims, 9 Drawing Sheets

WINDOW ASSEMBLY WITH INTEGRATED PLEATED SCREEN

FIELD OF THE INVENTION

The present invention relates to a window assembly. More particularly, the present invention relates to a window assembly, such as a double-hung window assembly for example, provided with an integrated pleated screen. The present patent application claims priority of U.S. Patent Provisional Application No. 60/587,501 filed Jul. 14th, 2004, the contents of which are incorporated herein by reference.

BACKGROUND OF THE INVENTION

Window assemblies, such as double-hung window assemblies, are very well known in the art. Indeed, a conventional double-hung window assembly typically consists of at least two panels, an upper sash and a lower sash, these two sashes being moveable with respect to each other in a slidable manner, similarly to the movement of a double-hung.

It is also known in the art that window assemblies are generally provided with fly screens, known also simply as "screens", in order to prevent the intrusion of flies and other insects into a given room when the window assembly is in an opened configuration.

For most window assemblies, and typically for double-hung window assemblies, the screen is generally positioned on the outer portion of the window assembly, which thus creates a visual impediment, in addition to creating an obstacle for the field of vision through the window. Indeed, these conventional fly screens not only hinder the esthetics of the window assembly (e.g. its decorative elements, such as muntins, muntin bars, divided lights which are typical to colonial-style window assemblies, etc.), but also prevent from seeing in an optimal manner, through the window, any sort of decorations which could be provided along the framework of the window assembly. Hence, a major problem associated with conventional fly screens is that even when the window assemblies are in a closed configuration, they nevertheless result in a partial visual screening of the window assembly and the field of view therethrough, which is very disadvantageous, for obvious reasons.

Also known in the art are the fly screens which can be removably mounted onto the window assemblies so as to install them when the window assembly is in an opened configuration, for example, so as to prevent flies and other insects from going through the window, and enabling the screen to be removed, when the window assembly is in a closed configuration, thereby not impeding the field of view which may be attained through the glass panels of the window assembly. However, a major disadvantage associated with these types of screens is that when they are not being used on the window assemblies, they need to be stored, or very often, lie around the given window assembly, which is fairly cumbersome and thus disadvantageous for obvious reasons known in the art.

Other types of screens known in the prior art are generally known as "roll-down" screens, which are typically spring-loaded. Indeed, very often, in many cases, some homeowners with conventional double-hung type window assemblies have homes which face the ocean view or other beautiful panoramic sites, and as a result, do not wish to employ the above-mentioned types of screens in order not to obstruct the field of view onto the landscape. Thus, very often, an alternative type of screen is known as the "roll-down" screen which essentially is a type a rollable screen, similar to that of a Venetian blind, which is installed within a type of casing of about two to four inches deep, typically, and which is operated depending on whether the screen is intended to be used or not. Thus, if one wishes to use the screen, it is simply unrolled, and pull-down, in order to cover the area to be screened of the window assembly. Typically also, this type of roll-down screen has a pair of lateral guiding rails for guiding movement of the roll-down screen. A major problem associated with this type of screen is that if one wishes to install on existing window assemblies, one has to substantially modify the framing and molding arrangement of the window assembly. Indeed, as previously explained, these types of roll-down screens generally require to be employed within a typical two to four-inch casing, and as result thereof, substantial modifications need to be made to the frame and to the molding of the window assemblies. Under certain circumstances, the studwork of the balloon frames has to be increased. Indeed, very often, the depth of the jambs or wood framing of the window assemblies need to be extended, and thus, this requires substantial work, materials, tooling, etc., and is thus very costly, which is also very disadvantageous for obvious reasons known in the art.

Hence, in light of the above-discussed, there is a need for an improved window assembly which would be able to overcome some of the aforementioned prior art problems.

SUMMARY OF THE INVENTION

The object of the present invention is to provide a window assembly which, by virtue of its design and components, satisfies some of the above-mentioned needs, and which is thus an improvement over other window assemblies known in the prior art.

In accordance with the present invention, the above object is achieved, as will be easily understood, with a window assembly such as the one briefly described herein and such as the one exemplified in the accompanying drawings.

In accordance with the present invention, there is provided a window assembly, the window assembly comprising:

a window frame comprising:

a pair of spaced-apart side frame members;

a first end frame member connected to a first end of the pair of side frame members; and a second end frame member connected to a second end of the pair of side frame members opposite the first end of the pair of side frame members;

at least a pair of spaced-apart guide tracks, each of the pair of spaced-apart guide tracks being connected to a respective one of the side frame members;

at least one window sash mounted to and positioned between the at least a pair of spaced-apart guide tracks and being slidably movable along the guide tracks between an open position wherein an end of the at least one window sash is spaced apart from the first end frame member and a closed position wherein the end of the at least one window sash abuttingly contacts the first end frame member; and a foldable and spreadable pleated screen, wherein the pleated screen has a first screen end mounted to the end of the at least one window sash and a second screen end mounted to the first end frame member so that the pleated screen extends when the at least one window sash is in the open position and the pleated screen folds onto itself when the at least one window sash is in the closed position.

In accordance with the present invention, there is also provided a window assembly, the window assembly comprising:

a window frame comprising:

a pair of spaced-apart side frame members;

a first end frame member connected to a first end of the pair of side frame members; and a second end frame member connected to a second end of the pair of side frame members opposite the first end of the pair of side frame members;

at least a pair of spaced-apart guide tracks, each of the pair of spaced-apart guide tracks being connected to a respective one of the side frame members;

at least one window sash mounted to and positioned between the at least a pair of spaced-apart guide tracks and being slidably movable along the guide tracks between an open position wherein an end of the at least one window sash is spaced apart from the first end frame member and a closed position wherein the end of the at least one window sash abuttingly contacts the first end frame member; and a foldable and spreadable pleated screen, wherein the pleated screen has a first screen end removably mounted to the end of the at least one window sash and a second screen end removably mounted to the first end frame member so that the pleated screen extends when the at least one window sash is in the open position and the pleated screen folds onto itself when the at least one window sash is in the closed position.

In accordance with the present invention, there is also provided a window assembly, the window assembly comprising:

a window frame comprising:

a pair of spaced-apart side frame members;

a first end frame member connected to a first end of the pair of side frame members; and a second end frame member connected to a second end of the pair of side frame members opposite the first end of the pair of side frame members;

at least two pairs of spaced-apart guide tracks, each of the pair of spaced-apart guide tracks being connected to a respective one of the side frame members;

at least a pair of window sashes, one of the pair of window sashes being mounted to and positioned between one of the at least two pair of spaced-apart guide tracks and being slidably movable along the one of the at least two pair of spaced-apart guide tracks between an open position wherein a first end of the one of the pair of window sashes is spaced apart from the first end frame member and a closed position wherein the first end of the one of the pair of window sashes abuttingly contacts the first end frame member; and a foldable and spreadable pleated screen, wherein the pleated screen has a first screen end removably mounted to the first end of the one of the pair of window sashes and a second screen end removably mounted to the first end frame member so that the pleated screen extends when the one of the pair of window sashes is in the open position and the pleated screen folds onto itself when the one of the pair of window sashes is in the closed position.

According to another aspect of the invention, there is also provided a room provided with the above-mentioned window assembly.

According to yet another aspect of the invention, there is also provided a building provided with the above-mentioned window assembly.

According to yet another aspect of the invention, there is also provided a method for operating the above-mentioned window assembly and the components thereof.

According to yet another aspect of the invention, there is also provided a kit for assembling the above-mentioned window assembly.

The objects, advantages and other features of the present invention will become more apparent upon reading of the following non-restrictive description of preferred embodiments thereof, given for the purpose of exemplification only, with reference to the accompanying drawings.

DETAILED DESCRIPTION OF PREFERRED EMBODIMENTS OF THE INVENTION

Figure 1:
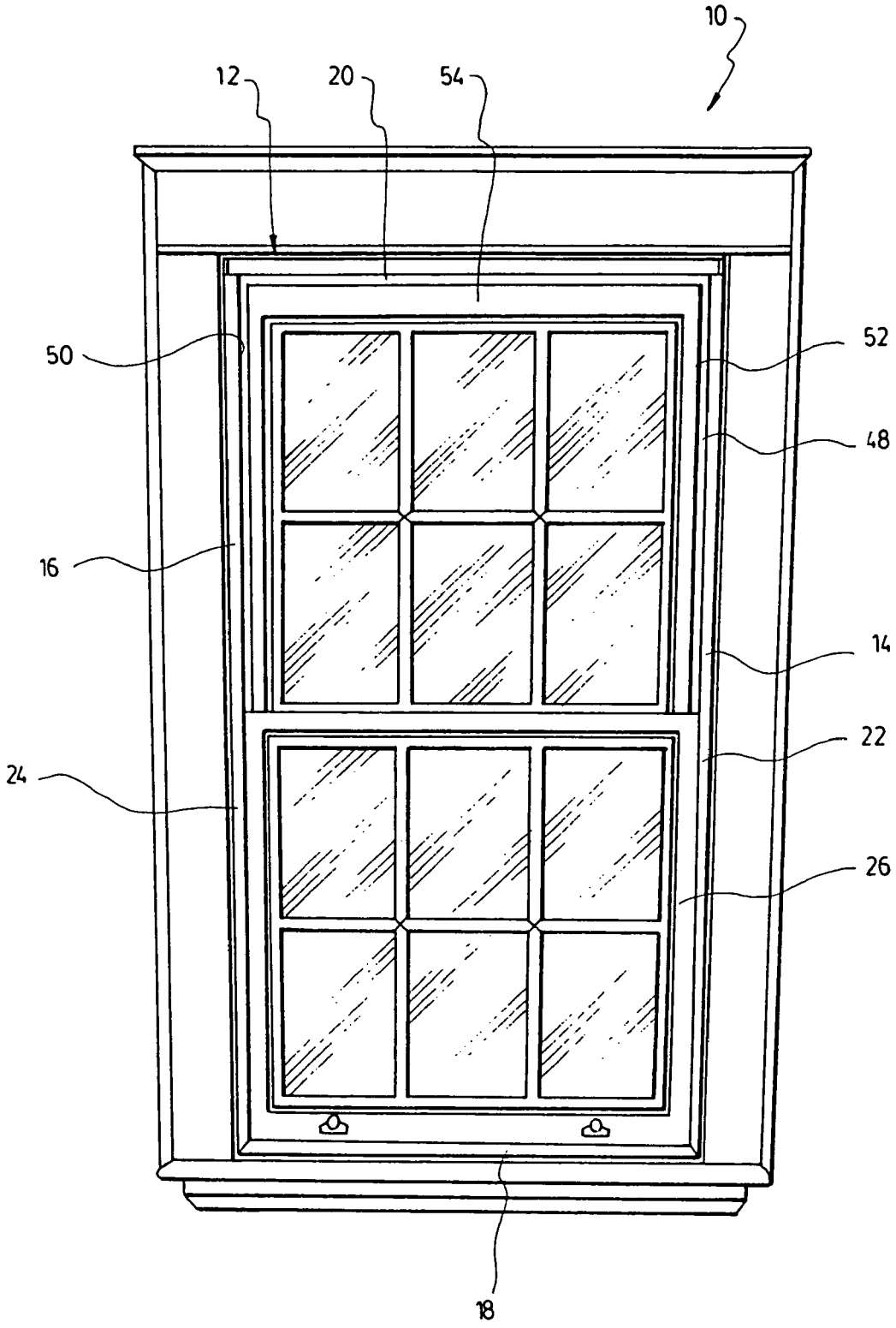
FIG. 1 is a front view of a window assembly according to a preferred embodiment of the present invention, the window assembly being shown in a closed configuration.
Figure 2:
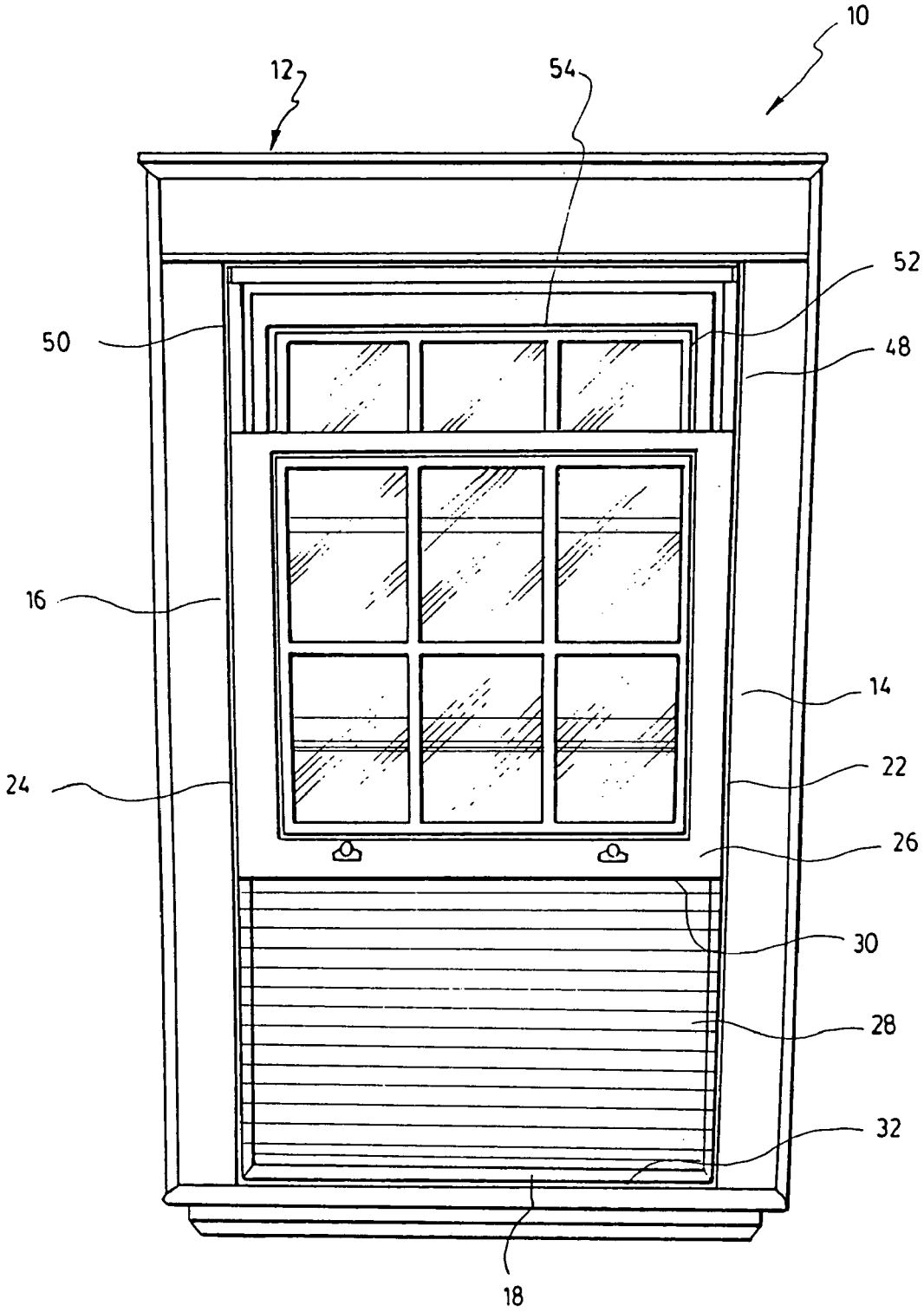
FIG. 2 is another front view of the window assembly of FIG. 1, the window assembly being shown now in an opened configuration, and thus with the integrated pleated screen being retracted.
Figure 3:
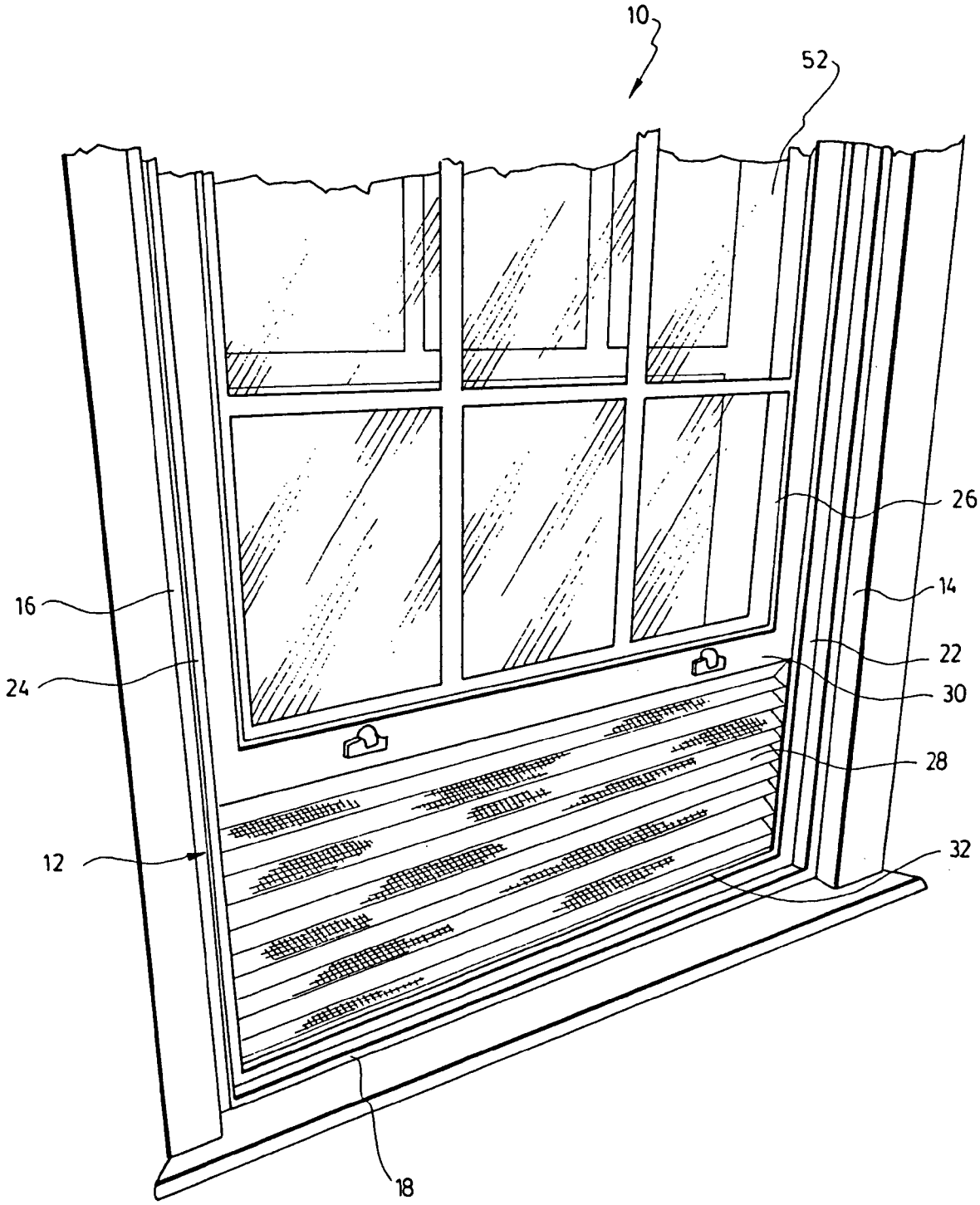
FIG. 3 is perspective view of the window assembly of FIG. 2, the window assembly being shown now in an intermediate opened configuration.

In the following description, the same numerical references refer to similar elements. The embodiments shown in the figures are preferred.

Moreover, although the present invention was primarily designed for use with a double-hung window assembly, it may be used with other types of window assemblies and objects (e.g. doors, vents, etc.) and in other fields, as apparent to a person skilled in the art. For this reason, expressions such as "double-hung", "window", etc. used herein should not be taken as to limit the scope of the present invention and includes all other kinds of window assemblies or items with which the present invention could be used and may be useful.

Moreover, in the context of the present invention, the expressions "window", "assembly", "device", and any other equivalent expression and/or compound words thereof known in the art will be used interchangeably. Furthermore, the same applies for any other mutually equivalent expressions, such as "fly screen" and "screen", "rod" and "bar", as well as "frame" and "window" for example, as also apparent to a person skilled in the art.

In addition, although the preferred embodiment of the present invention as illustrated in the accompanying drawings comprises various components and although the preferred embodiment of the window assembly as shown consists of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperations thereinbetween, as well as other suitable geometrical configurations may be used for the window assembly and corresponding parts according to the present invention, as briefly explained and inferred herein, without departing from the scope of the invention.

Broadly described, the window assembly according to the present invention, as shown in the accompanying drawings, is a window assembly with an integrated pleated or "foldable" screen.

Referring to any one of FIGS. 1 to 9, a window assembly 10 is shown.

Turning now in particular to FIGS. 1 to 5, the window assembly 10 comprises a window frame 12. The window frame 12 comprises a pair of spaced-apart side frame members 14, 16. The window frame also comprises a first end frame member 18 connected to a first end of the pair of side frame members l4, 16, as well as a second end frame member 20 connected to a second end of the pair of side frame members 14, 16 opposite the first end of the pair of side frame members 14, 16. The window assembly 10 further comprises at least a pair of spaced-apart guide tracks 22, 24, each of the pair of spaced-apart guide tracks 22, 24 being connected to a respective one of the side frame members 14, 16. The window assembly further comprises at least one window sash 26 mounted to and positioned between the at least a pair of spaced-apart guide tracks 22, 24. The window sash 26 is slidably movable along the guide tracks 22, 24 between an open position wherein an end of the window sash 26 is spaced apart from the first end frame member 18 and a closed position wherein the end of the window sash 26 abuttingly contacts the first end frame member 18. The window assembly 10 further comprises a foldable and spreadable pleated screen 28. The pleated screen 28 has a first screen end 30 mounted to the end of the at least one window sash 26 and a second screen end 32 mounted to the first end frame member 18 so that the pleated screen 28 extends when the at least one window sash 26 is in the open position and the pleated screen 28 folds onto itself when the at least one window sash 26 is in the closed position.

According to another embodiment of the present invention, the pleated screen 28 has a first screen end 30 removably mounted to the end of the at least one window sash 26 and a second screen end 32 removably mounted to the first end frame member 18 so that the pleated screen 28 extends when the at least one window sash 26 is in the open position and the pleated screen 28 folds onto itself when the at least one window sash 26 is in the closed position.

Figure 5:
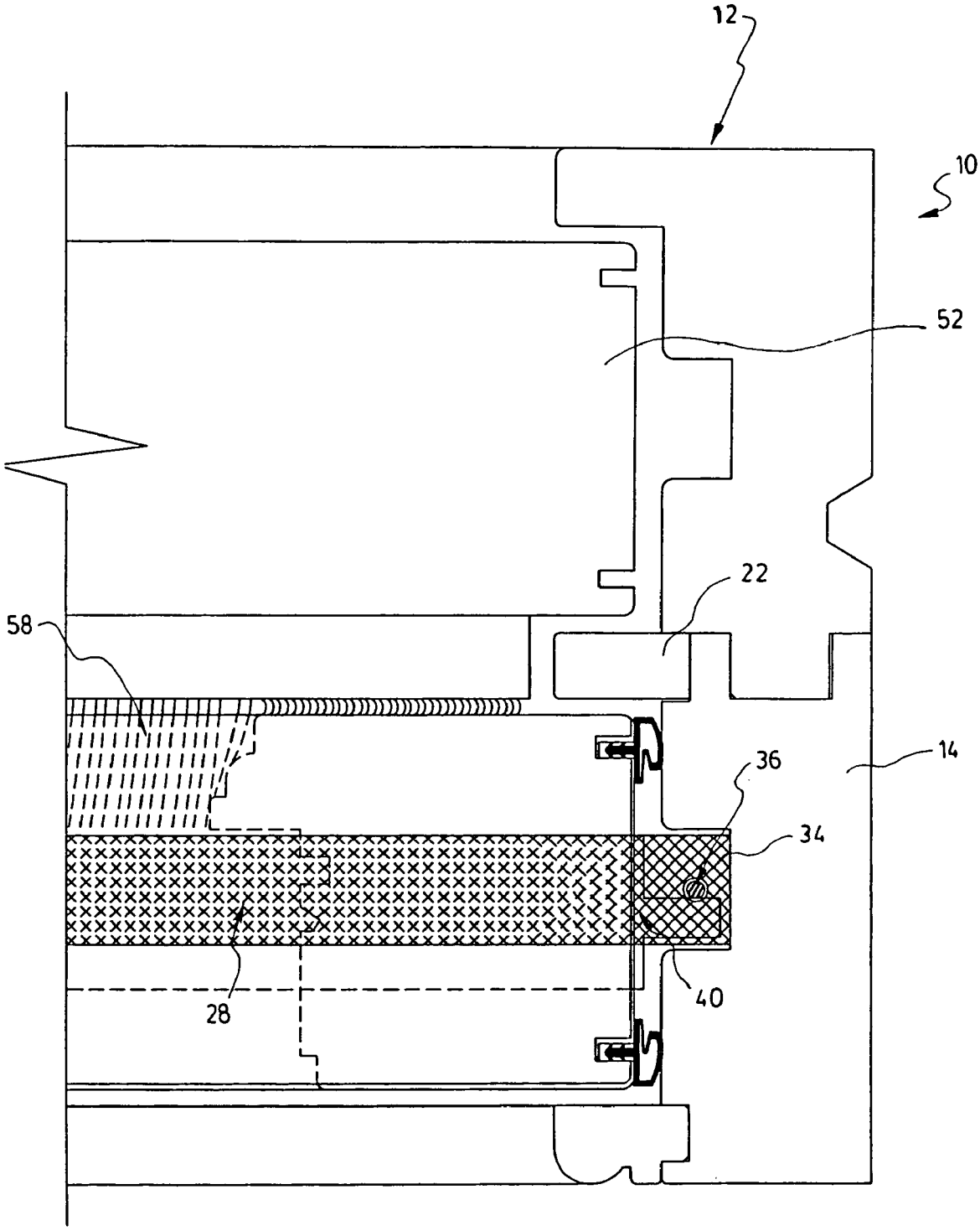
FIG. 5 is a top cross-sectional view of the window assembly shown in FIG. 4.

Preferably, as shown in FIG. 5, side ends 34 of the pleated screen 28 are guided by the at least a pair of spaced-apart guide tracks 22, 24.

Preferably, the window assembly 10 further comprises at least two tubes 36, each of the tubes 36 being located within a respective one of the at least a pair of spaced-apart guide tracks 22, 24 and each of the tubes traversing holes in a respective one of the side ends 34 of the pleated screen 28.

Figure 4:
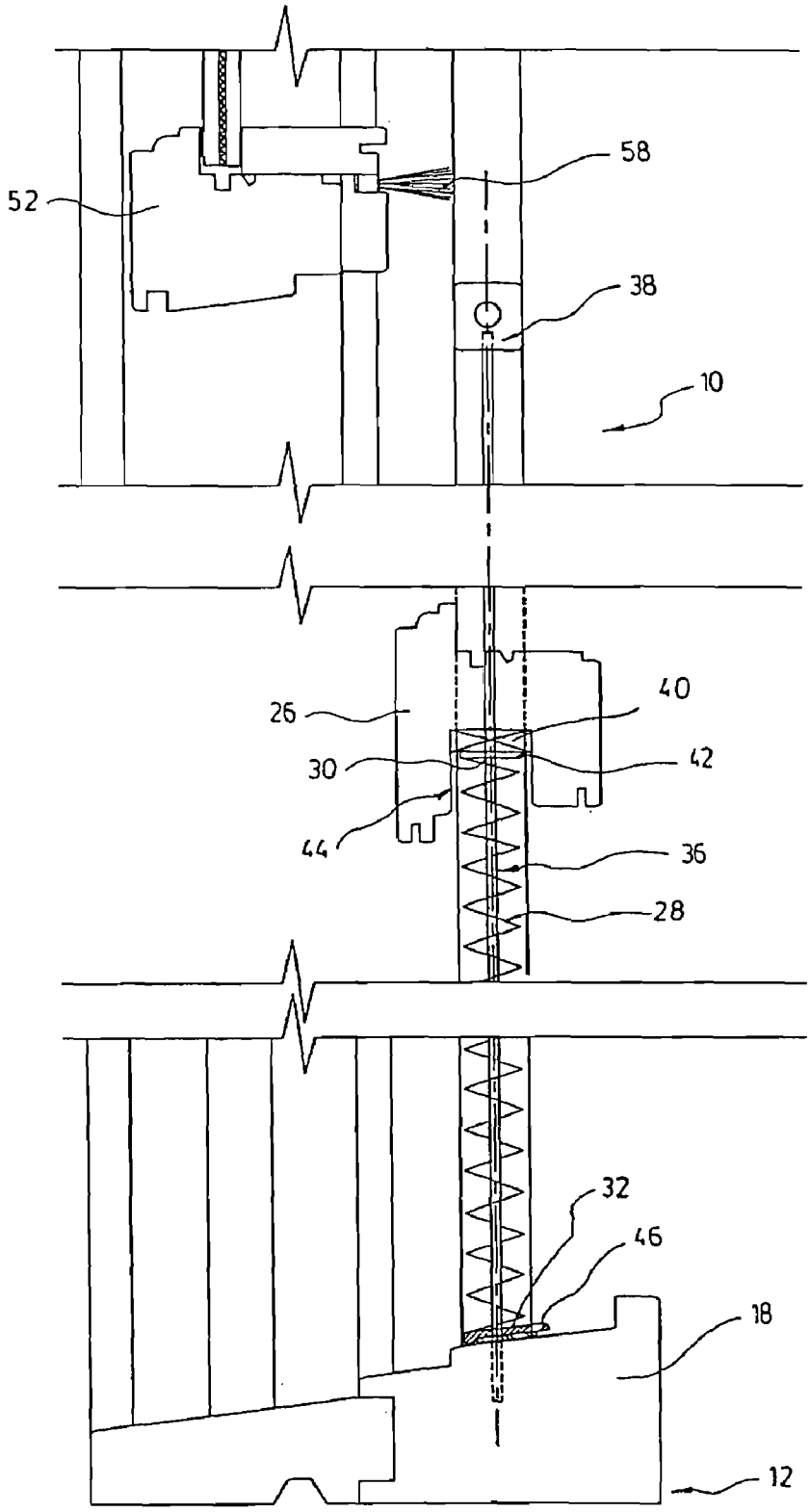
FIG. 4 is a partial elevational cross-sectional view of a window assembly according to yet another preferred embodiment of the present invention, the window assembly being shown in an opened configuration.

Preferably, as shown in FIG. 4, each of the tubes 36 is connected to a top bar holder 38 located within the at least one window sash structure, to a lateral tube guide 40 attached to the end 42 of the at least one window sash 26 and to the first end frame member 18.

Preferably, each of the tubes 36 is made of a fluorinated polymer.

Preferably, the end of the at least one window sash 26 comprises a cavity 44 formed therein extending substantially the length of the end of the at least one window sash and the pleated screen 28 is housed within the cavity 44 when the at least one window sash is in the closed position.

This configuration offers an advantage with respect to windows having rolled-up screens where the roller is located and concealed within the window sill, which results in design problems as the sill must accommodate the displacement of water circulating down the window during rainfall. Having the pleated screen housed primarily within the window sash avoids this problem. However, in certain cases, it might nevertheless be desirable in other window designs to house the pleated screen within the sill or frame as described below.

Preferably, in accordance with another preferred embodiment, the first end frame member 18 comprises a cavity formed therein extending substantially the length of the first end frame member and the pleated screen 28 is housed within the cavity when the at least one window sash 26 is in the closed position.

Preferably and as shown in FIG. 4, the second screen end of the pleated screen 32 comprises a lamella 46 along a length thereof to maintain contact between the second end of the pleated screen 28 and the first end frame member 18 through a dead weight of the lamella 46.

Preferably, the lamella 46 is made of a metal selected from the group consisting of bronze and brass.

In accordance with another embodiment of the present invention, the window assembly 10 comprises a window frame 12. The window frame 12 comprises a pair of spaced-apart side frame members 14, 16. The window frame also comprises a first end frame member 18 connected to a first end of the pair of side frame members 14, 16, as well as a second end frame member 20 connected to a second end of the pair of side frame members 14, 16 opposite the first end of the pair of side frame members 14, 16. The window assembly further comprises at least two pairs of spaced-apart guide tracks 22,24,48,50, each of the pair of spaced-apart guide tracks being connected to a respective one of the side frame members 14, 16. The window assembly further comprises at least a pair of window sashes 26,52, one of the pair of window sashes 26 being mounted to and positioned between one of the at least two pair of spaced-apart guide tracks 22, 24 The window sash 26 is slidably movable along the guide tracks 22,24 between an open position wherein a first end 32 of the one of the pair of window sashes 26 is spaced apart from the first end frame member 18 and a closed position wherein the first end of the one of the pair of window sashes 26 abuttingly contacts the first end frame member 18. The window assembly 10 further comprises a foldable and spreadable pleated screen 28. The pleated screen 18 has a first screen end 30 removably mounted to the first end of the one of the pair of window sashes 26 and a second screen end 32 removably mounted to the first end frame member 18 so that the pleated screen 28 extends when the one of the pair of window sashes 26 is in the open position and the pleated screen 28 folds onto itself when the one of the pair of window sashes 26 is in the closed position.

Figure 9:
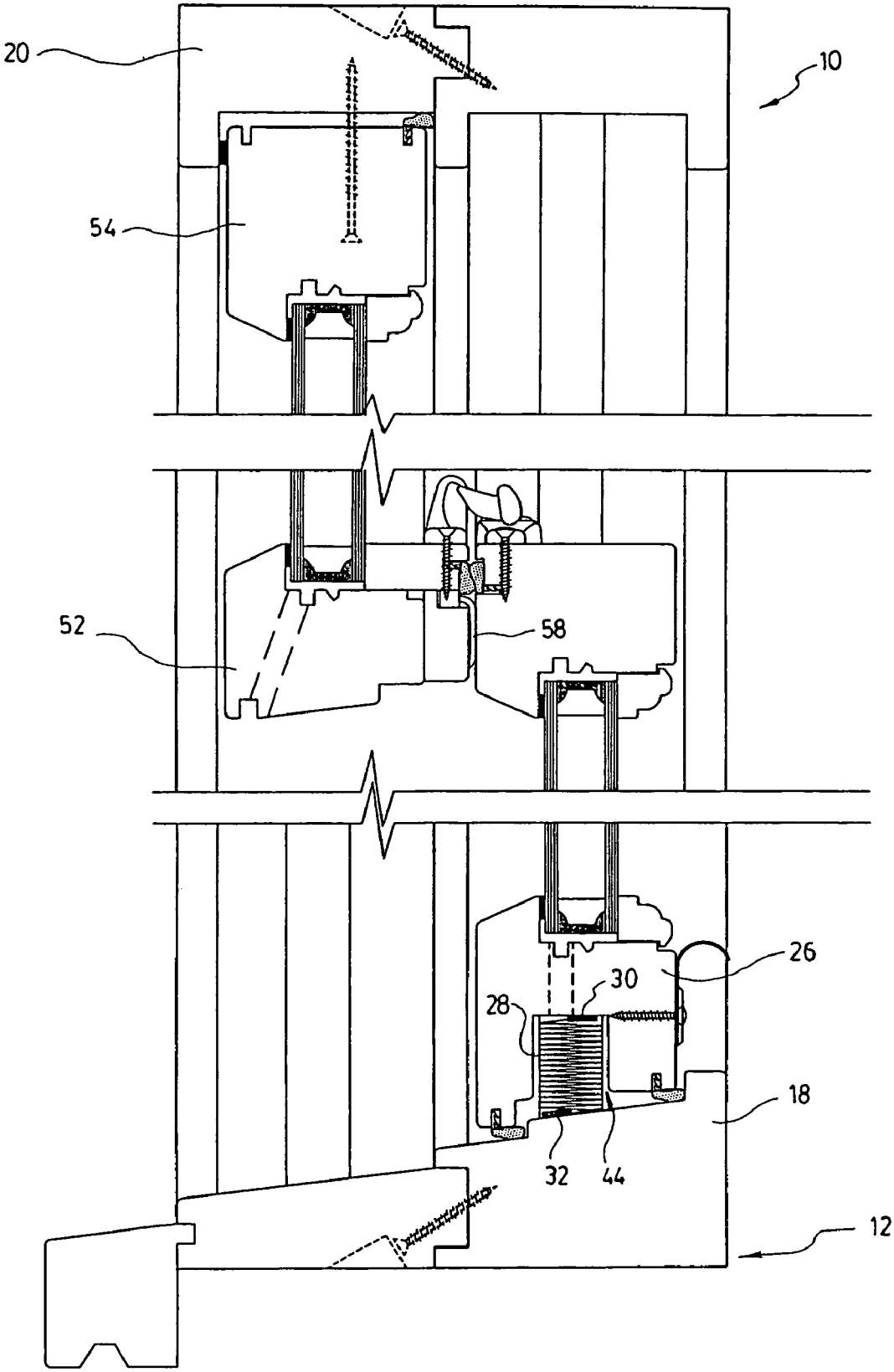
FIG. 9 is a partial elevational cross-sectional view of a window assembly according to yet another preferred embodiment of the present invention, the window assembly being shown in a closed configuration for a double-hung window.

Preferably, another one of the pair of window sashes 52 is mounted to and positioned between another one of the at least two pair of spaced-apart guide tracks 48, 50. This other window sash 52 is slidably movable along the another one of the at least two pair of spaced-apart guide tracks 48, 50 between an open position wherein a first end 54 of the another one of the pair of window sashes 52 is spaced apart from the second end frame member 20 and a closed position wherein the first end 54 of the another one of the pair of window sashes 52 abuttingly contacts the second end frame member 20. As shown in FIG. 9, this second sash can include an integrated pleated screen that extends when the second window sash is in the open position. The second pleated screen folds onto itself when the second window sash is in the closed position.

Preferably, as shown in FIGS. 4 to 9, a second end 56 of the another one of the window sashes 52 opposite the first end 54 comprises a pivotable flap 58 having an extremity in movable contact with the one of the pair of window sashes 26 in the area of the meeting rail.

In accordance with another preferred embodiment of the present invention, a second end of the one of the window sashes opposite the first end comprises a pivotable flap having an extremity in movable contact with another one of the pair of window sashes in the area of the meeting rail.

Preferably, the pivotable flap is selected from a group consisting of a brush and a nylon strip.

Figure 6:
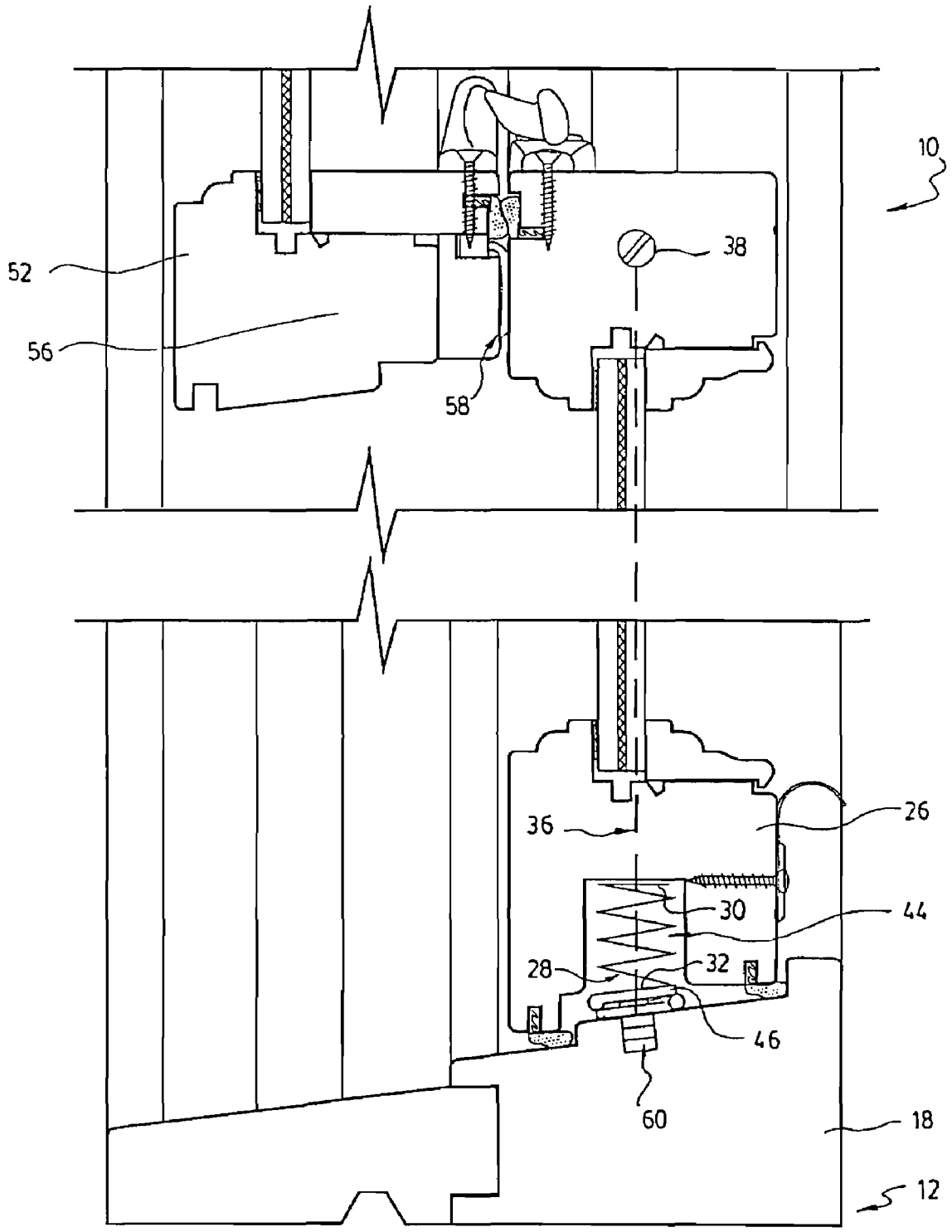
FIG. 6 is a partial elevational cross-sectional view of a window assembly according to another preferred embodiment of the present invention, the window assembly being shown in a closed configuration.
Figure 7:
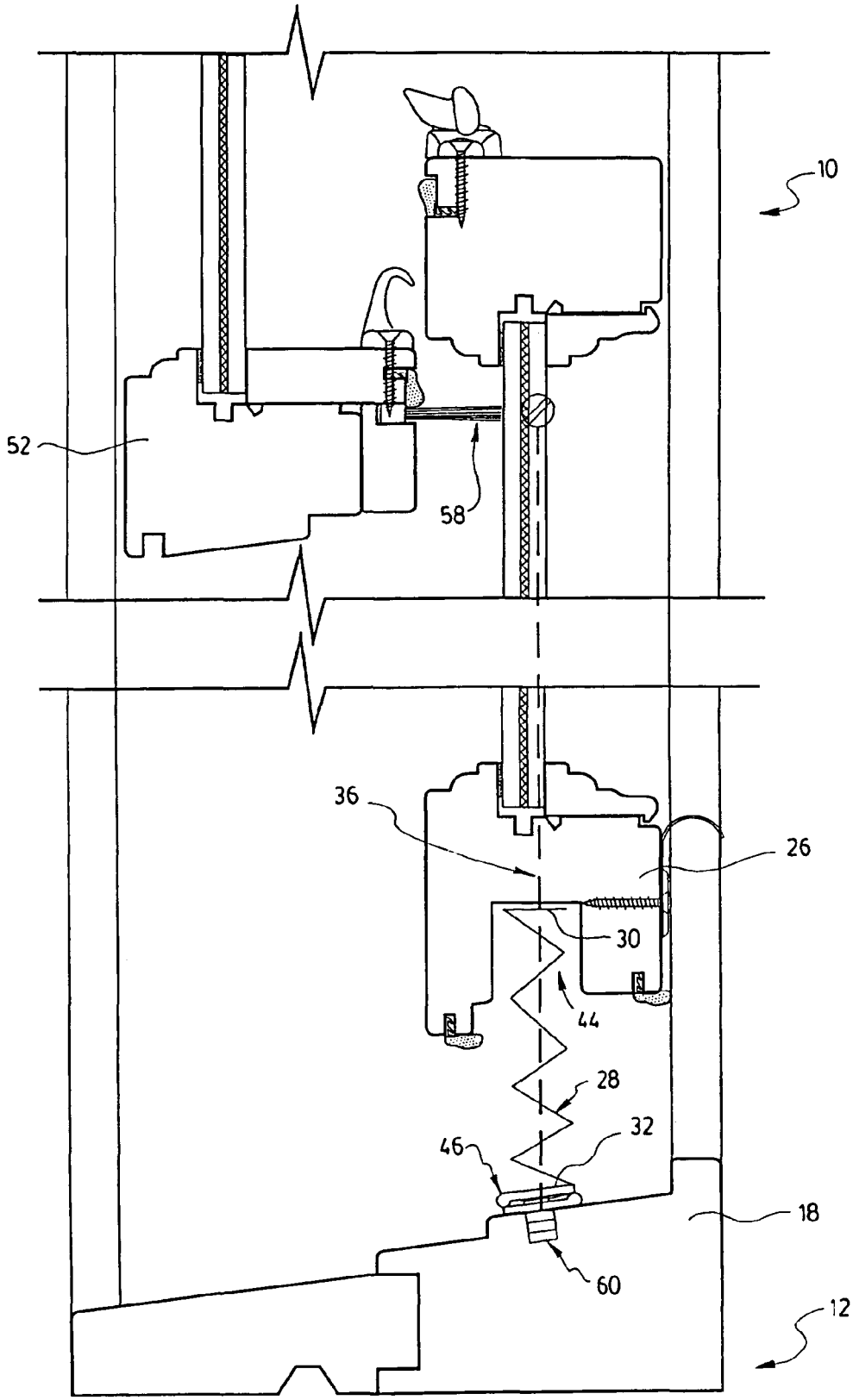
FIG. 7 is another view of the window assembly of FIG. 6, the window assembly being shown now in an opened configuration, and thus with the integrated pleated screen being retracted.

In accordance with another preferred embodiment, as shown in FIGS. 6 and 7, either the first or second end frame members may comprise a magnet 60 in order to maintain contact between the pleated screen comprising a metallic lamella and the end frame member. This feature is particularly useful if a pleated screen must extend to a top window frame member above the top sash of a double-hung window, in window assemblies similar to the one shown in FIG. 9.

Figure 8:
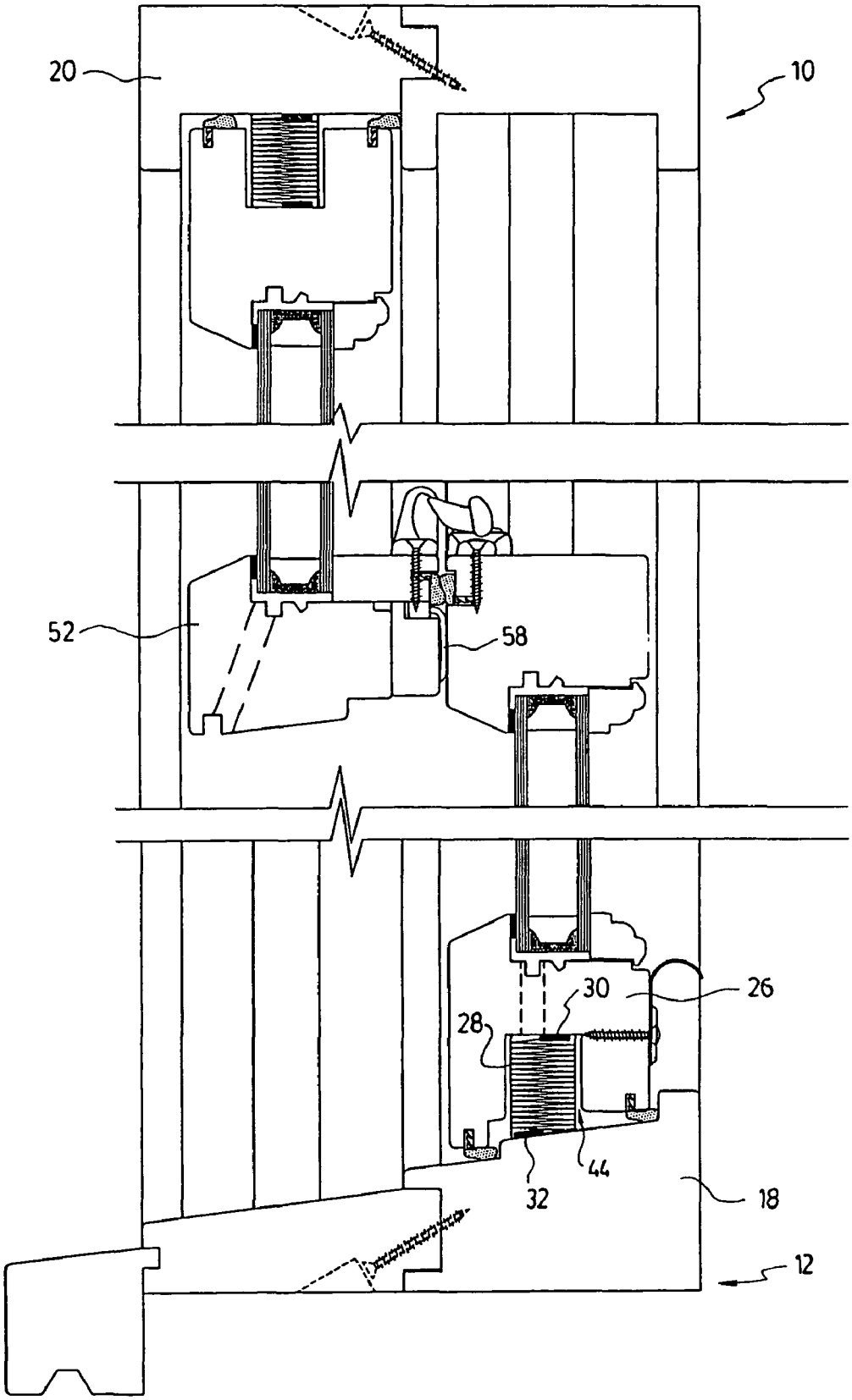
FIG. 8 is a partial elevational cross-sectional view of a window assembly according to yet another preferred embodiment of the present invention, the window assembly being shown in a closed configuration for a single-hung window.

In a certain vertical single or double-hung windows, shown in FIGS. 8 and 9 respectively, the side frame members may correspond to the jambs of the window. Similarly, the first end frame member corresponds to the sill while the second end frame member corresponds to the head jamb. However, these designations can change depending on the overall configuration of the window.

Thus, according to the present invention, and as can be easily understood by a person skilled in the art in view of the accompanying drawings, in order to overcome the problematic of visual screening, and in order to have a better vision through the glass panel of the window assembly when in a closed configuration, without hindering in any sort of possible way the esthetic aspects of the exterior, the present window assembly comprises an integrated pleated screen which is folded onto itself and thus remains "invisible" when the window assembly is in a closed configuration, as can be easily understood when referring particularly to FIG. 1, 6, 8 or 9. Indeed, the present window assembly and/or the pleated screen thereof is preferably commercialized under a suitable trademark, such as Philharmonica™, given the fact that this is an Italian name which means accordion, and which is analogous to the pleated screen of the present invention in that it can be folded onto itself, instead of rolling on itself, as is the case with conventional roll-down screens.

Moreover, and as may now better be appreciated when reviewing the accompanying drawings, an important advantage of the present invention resides in that if one wishes to employ the pleated screen, one simply has to open the window assembly, that is, lift or "slide" the bottom sash with respect to the top sash, thereby driving the unfolding of the pleated screen. Conversely, when the window assembly is operated back into a closed configuration, the pleated screen folds back onto itself and no longer becomes a visual impediment, as also better illustrated in FIG. 1, 6, 8 or 9. Another important advantage of the present invention resides in the fact that the pleated screen is also preferably devised to have corresponding components cooperating therewith in order to enable it to be easily and quickly removed from its corresponding components onto which it is attached. Thus, if a user has to remove the foldable and pleated screen in order to have access to the exterior of the window assembly from the inside, then one simply has to remove the pleated screen by detaching it from its corresponding components, as illustrated in the accompanying drawings, because additional fasteners are provided according to the present invention in order to enable it to be easily and quickly removed. In fact, one simply has to raise it to the interior or the groove or cavity which is found on the transversal base of the opening sash which is slidable. Alternatively, the top components of the pleated screen could be removed so as to lower the pleated screen and fold it onto the bottom rail, as can be easily understood by a person skilled in the art when referring to the accompanying drawings.

As can also be understood by the accompanying drawings, the pleated screen is preferably maintained at the bottom by a bronze lamella, or by a lamella made of any other suitable material, such as brass, and the like, which is relatively heavy, and thus, there is no need for any mechanical attachment since it is maintained there by the effect of gravity. Thus, in order to raise the whole thing, into the upper groove, it is child's play in that one simply has to take it and go insert it into its corresponding groove after which, once the pleated screen is folded upwardly and folded into the upper recess, and affixed there, one may have access to the exterior of the window assembly, in order to have access for example to flower pots, the exterior face of the window, etc.

Moreover, as can be easily understood, the present window assembly is also advantageous in that according to the American practice, and American regulations concerning "egress windows", bedrooms are required to have windows which enable an easy and quick evacuation. Thus, it may now better be appreciated that the window assembly and the components and features thereof enable for a user to quickly exit the window assembly by simply removing the pleated screen, which is fairly easy, as explained above.

As illustrated in the accompanying drawings, the window assembly according to the present invention preferably comprises various components, each of which are not necessarily essential, but do indeed provide substantial advantages. For example, the flexible anti-intrusion brush also referred to as a flexible flies stopper brush is there to prevent insects and the like from entering the room by passing under the upper slidable sash of the window assembly. This can be easily understood when referring to FIGS. 4 to 7 which illustrate how the brush prevents insects located "outside" of the room (right side of the window assembly) from entering "inside" of the room (left side of the window assembly).

According to a preferred embodiment of the present invention, the window assembly preferably comprises a holding bar which is preferably devised so that on each side thereof, guiding means, preferably provided with Teflon™, prevent the fly screen from coming out of its vertical plane. Indeed, as can be easily understood from the accompanying drawings, a special type of profiling enables to the above-mentioned bar to receive a Teflon™ tube, and this tube, is allowed to move within a type of cavity which prevents the fly screen from coming out of its vertical plane.

According to the present invention, the window assembly preferably comprises also fasteners which are added to the guiding means, which as previously mentioned, are preferably made out of Teflon™, and which are hooked against the section itself, to ensure at the same time, that there is no derailing of the pleated screen. The wires of each side are preferably replaced by a suitable rod, which is preferably made of a stainless steel, or any other suitable material, as apparent to a person skilled in the art. Preferably, this rod is of about 1/16" or a little bit less, which corresponds to about 2 mm in diameter, in order to ensure, a better sliding, as can be easily understood by a person skilled in the art. This type of configuration enables for thus a more smooth and problem-free operation.

As may now be appreciated, the present invention is a substantial improvement over the prior art in that, by virtue of its design and components, the window assembly is very simple and easy to use, as well as is very simple and easy to manufacture and/or assemble, without compromising the reliability of its functions. Hence, it may now be appreciated that the present invention represents important advantages over other window assemblies known in the prior art, in terms of performance and in terms of costs.

The present invention is also an improvement and presents several advantages over other window assemblies known on the prior art in that it may be used with new window assemblies or existing window assemblies, whether commercial or residential.

Of course, numerous modifications could be made to the above-described embodiments without departing from the scope of the invention, as apparent to a person skilled in the art.

The invention claimed is:

1. A window assembly, the window assembly comprising:

a window frame comprising:

a pair of spaced-apart side frame members;

a first end frame member connected to a first end of the pair of side frame members, said first end frame member comprising a substantially planar window sash contact surface; and a second end frame member connected to a second end of the pair of side frame members opposite the first end of the pair of side frame members;

at least a pair of spaced-apart guide tracks, each of the pair of spaced-apart guide tracks being connected to a respective one of the side frame members;

at least one window sash mounted to and positioned between the at least a pair of spaced-apart guide tracks and being slidably movable along the guide tracks between an open position wherein an end of the at least one window sash is spaced apart from the first end frame member and a closed position wherein the end of the at least one window sash abuttingly contacts the first end frame member window sash contact surface;

a foldable and spreadable continuous seamless pleated screen, said pleated screen comprising a single integral continuous unitary seamless flexible screen element, and at least two tubes, each of the tubes being located within a respective one of the at least a pair of spaced-apart guide tracks, each of the tubes traversing holes in a respective one of the side ends of the pleated screen and each of the tubes being housed within a respective one of the side frame members, wherein the pleated screen has a first screen end mounted to the end of the at least one window sash and a second screen end mounted to the first end frame member so that the pleated screen extends when the at least one window sash is in the open position and the pleated screen folds onto itself when the at least one window sash is in the closed position, wherein a second end of one of the window sashes opposite the first end comprises a pivotable flap having an extremity in movable contact with another one of the pair of window sashes, and wherein the end of the at least one window sash comprises a cavity formed therein extending substantially the length of the end of the at least one window sash and the pleated screen is housed within the cavity when the at least one window sash is in the closed position.

2. A window assembly, the window assembly comprising:

a window frame comprising:

a pair of spaced-apart side frame members;

a first end frame member connected to a first end of the pair of side frame members, said first end frame member comprising a substantially planar window sash contact surface; and a second end frame member connected to a second end of the pair of side frame members opposite the first end of the pair of side frame members;

at least a pair of spaced-apart guide tracks, each of the pair of spaced-apart guide tracks being connected to a respective one of the side frame members;

at least one window sash mounted to and positioned between the at least a pair of spaced-apart guide tracks and being slidably movable along the guide tracks between an open position wherein an end of the at least one window sash is spaced apart from the first end frame member and a closed position wherein the end of the at least one window sash abuttingly contacts the first end frame member window sash contact surface;

a foldable and spreadable continuous seamless pleated screen, said pleated screen comprising a single integral continuous unitary seamless flexible screen element; and at least two tubes, each of the tubes being located within a respective one of the at least a pair of spaced-apart guide tracks, each of the tubes traversing holes in a respective one of the side ends of the pleated screen and each of the tubes being housed within a respective one of the side frame members, wherein the pleated screen has a first screen end mounted to the end of the at least one window sash and a second screen end mounted to the first end frame member so that the pleated screen extends when the at least one window sash is in the open position and the pleated screen folds onto itself when the at least one window sash is in the closed position, wherein a second end of one of the window sashes opposite the first end comprises a pivotable flap having an extremity in movable contact with another one of the pair of window sashes, and wherein the end of the at least one window sash comprises a cavity formed therein extending substantially the length of the end of the at least one window sash and the pleated screen is housed within the cavity when the at least one window sash is in the closed position.

3. The window assembly according to claim 1, wherein side ends of the pleated screen are guided by the at least a pair of spaced-apart guide tracks.

4. The window assembly according to claim 1, wherein each of the tubes is made of a fluorinated polymer.

5. The window assembly according to claim 2, wherein the second screen end of the pleated screen comprises a lamella along a length thereof to maintain contact between the second end of the pleated screen and the first end frame member through a dead weight of the lamella and wherein the lamella is installable in a groove offset from the first end frame member, in order to maintain the pleated screen in a second alternate open configuration.

6. The window assembly according to claim 5, wherein the lamella is made of a metal selected from the group consisting of bronze and brass.

7. A window assembly, the window assembly comprising:

a window frame comprising:

a pair of spaced-apart side frame members;

a first end frame member connected to a first end of the pair of side frame members, said first end frame member comprising a substantially planar window sash contact surface; and a second end frame member connected to a second end of the pair of side frame members opposite the first end of the pair of side frame members;

at least two pairs of spaced-apart guide tracks, each of the pair of spaced-apart guide tracks being connected to a respective one of the side frame members;

at least a pair of window sashes, one of the pair of window sashes being mounted to and positioned between one of the at least two pair of spaced-apart guide tracks and being slidably movable along the one of the at least two pair of spaced-apart guide tracks between an open position wherein a first end of the one of the pair of window sashes is spaced apart from the first end frame member and a closed position wherein the first end of the one of the pair of window sashes abuttingly contacts the first end frame member window sash contact surface;

a foldable and spreadable continuous seamless pleated screen, said pleated screen comprising a single integral continuous unitary seamless flexible screen element, and at least two tubes, each of the tubes being located within a respective one of the at least a pair of spaced-apart guide tracks, each of the tubes traversing holes in a respective one of the side ends of the pleated screen and each of the tubes being housed within a respective one of the side frame members, wherein the pleated screen has a first screen end mounted to the end of the at least one window sash and a second screen end mounted to the first end frame member so that the pleated screen extends when the at least one window sash is in the open position and the pleated screen folds onto itself when the at least one window sash is in the closed position, wherein a second end of one of the window sashes opposite the first end comprises a pivotable flap having an extremity in movable contact with another one of the pair of window sashes, and wherein the end of the at least one window sash comprises a cavity formed therein extending substantially the length of the end of the at least one window sash and the pleated screen is housed within the cavity when the at least one window sash is in the closed position.

8. The window assembly according to claim 7, wherein another one of the pair of window sashes is mounted to and positioned between another one of the at least two pair of spaced-apart guide tracks and is slidably movable along the another one of the at least two pair of spaced-apart guide tracks between an open position wherein a first end of the another one of the pair of window sashes is spaced apart from the second end frame member and a closed position wherein the first end of the another one of the pair of window sashes abuttingly contacts the second end frame member.

9. The window assembly according to claim 8, wherein a second end of the another one of the pair of window sashes opposite the first end comprises a pivotable flap having an extremity in movable contact with the one of the pair of window sashes.

10. The window assembly according to claim 7, wherein the pivotable flap is selected from a group consisting of a brush and a nylon strip.

11. The window assembly according to claim 7, wherein side ends of the pleated screen are guided by the one of the at least two pair of spaced-apart guide tracks.

12. The window assembly according to claim 7, wherein the second screen end of the pleated screen comprises a lamella along a length thereof to maintain contact between the second end of the pleated screen and the first end frame member through a dead weight of the lamella and wherein the lamella is installable in a groove offset from the first end frame member, in order to maintain the pleated screen in a second alternate open configuration.

* * * * *